US011090209B2

(12) United States Patent
Paul

(10) Patent No.: US 11,090,209 B2
(45) Date of Patent: Aug. 17, 2021

(54) PATIENT SUPPORT APPARATUS WITH CONTROL SYSTEM AND METHOD TO AVOID OBSTACLES DURING RECONFIGURATION

(71) Applicant: Stryker Corporation, Kalamazoo, MI (US)

(72) Inventor: Anish Paul, Portage, MI (US)

(73) Assignee: Stryker Corporation, Kalamazoo, MI (US)

( * ) Notice: Subject to any disclaimer, the term of this patent is extended or adjusted under 35 U.S.C. 154(b) by 367 days.

(21) Appl. No.: 16/010,881

(22) Filed: Jun. 18, 2018

(65) Prior Publication Data

US 2018/0360681 A1 Dec. 20, 2018

Related U.S. Application Data

(60) Provisional application No. 62/522,233, filed on Jun. 20, 2017.

(51) Int. Cl.
*A61G 7/018* (2006.01)
*A61G 7/012* (2006.01)
(Continued)

(52) U.S. Cl.
CPC ..... *A61G 7/018* (2013.01); *A61G 7/005* (2013.01); *A61G 7/012* (2013.01); *A61G 7/015* (2013.01); *A61G 7/0507* (2013.01); *A61G 7/0514* (2016.11); *A61G 7/053* (2013.01); *A61G 7/0528* (2016.11); *A61G 7/08* (2013.01); *A61G 2203/30* (2013.01); *A61G 2203/36* (2013.01); *A61G 2203/38* (2013.01); *A61G 2203/42* (2013.01);
(Continued)

(58) Field of Classification Search
None
See application file for complete search history.

(56) References Cited

U.S. PATENT DOCUMENTS 4,325,061 A 4/1982 Wolar
4,407,030 A 10/1983 Elliott
(Continued)

FOREIGN PATENT DOCUMENTS

EP 1053735 A2 11/2000
EP 1108410 B1 8/2006
(Continued)

OTHER PUBLICATIONS

Stryker, "Modular Patient System (MPS) 3000 Bed Maintenance Manual", 3000-000-020 Rev B, Mar. 1994, 249 pages.

*Primary Examiner* — David R Hare
*Assistant Examiner* — Adam C Ortiz
(74) *Attorney, Agent, or Firm* — Howard & Howard Attorneys PLLC

(57) ABSTRACT

A patient support apparatus comprises a base and a patient support deck. The patient support deck comprises a back section capable of articulating relative to a seat section. A lift system lifts or lowers the patient support deck relative to the base. An articulation system articulates the back section relative to the seat section. Head end side rails are mounted to the back section to articulate with the back section. A controller controls operation of the lift system and/or the articulation system to prevent the head end side rails from colliding with obstacles, such as the floor surface.

18 Claims, 4 Drawing Sheets

(51) Int. Cl.

| | |
|---|---|
| ***A61G 7/05*** | (2006.01) |
| ***A61G 7/015*** | (2006.01) |
| ***A61G 7/005*** | (2006.01) |
| ***A61G 7/053*** | (2006.01) |
| ***A61G 7/08*** | (2006.01) |

(52) U.S. Cl.
CPC ..... *A61G 2203/72* (2013.01); *A61G 2210/50* (2013.01)

(56) References Cited

U.S. PATENT DOCUMENTS

| | | | |
|---|---|---|---|
| 4,534,077 | A | 8/1985 | Martin |
| 5,069,000 | A | 12/1991 | Zuckerman |
| 5,156,166 | A | 10/1992 | Sebring |
| 5,220,698 | A | 6/1993 | Hannant |
| 5,317,769 | A | 6/1994 | Weismiller et al. |
| 5,481,769 | A | 1/1996 | Schneider |
| 6,201,481 | B1 | 3/2001 | Bellingroth |
| 6,555,982 | B2 | 4/2003 | Tyckowski |
| 6,652,033 | B2 | 11/2003 | Satoh |
| 6,677,720 | B2 | 1/2004 | Fraser |
| 7,472,437 | B2 | 1/2009 | Riley et al. |
| 7,676,866 | B2 | 3/2010 | Toms et al. |
| 7,834,768 | B2 | 11/2010 | Dixon et al. |
| 7,914,076 | B2 | 3/2011 | Broering et al. |
| 7,926,131 | B2 | 4/2011 | Menkedick et al. |
| 7,978,084 | B2 | 7/2011 | Dixon et al. |
| 8,039,766 | B2 | 10/2011 | Flanagan |
| 8,134,473 | B2 | 3/2012 | Roussy |
| 8,258,944 | B2 | 9/2012 | Riley et al. |
| 8,502,663 | B2 | 8/2013 | Riley et al. |
| 8,514,093 | B2 | 8/2013 | Roussy |
| 8,866,610 | B2 | 10/2014 | Riley et al. |
| 8,959,681 | B2 * | 2/2015 | Richards ..... A61G 7/012 5/613 |
| 9,009,893 | B2 | 4/2015 | Kramer et al. |
| 9,182,750 | B2 | 11/2015 | Rawls-Meehan |
| 9,228,885 | B2 | 1/2016 | Zerhusen et al. |
| 9,517,171 | B2 | 12/2016 | Andersen et al. |
| 9,655,796 | B2 | 5/2017 | Riley et al. |
| 2014/0310876 | A1 | 10/2014 | Roussy et al. |
| 2014/0352067 | A1 | 12/2014 | Riley et al. |
| 2015/0224005 | A1 | 8/2015 | Kramer et al. |
| 2016/0022039 | A1 | 1/2016 | Paul et al. |
| 2016/0140307 | A1 | 5/2016 | Brosnan et al. |
| 2016/0166453 | A1 | 6/2016 | Furman et al. |
| 2016/0193095 | A1 | 7/2016 | Roussy et al. |
| 2016/0302985 | A1 | 10/2016 | Tessmer et al. |
| 2017/0124844 | A1 * | 5/2017 | Huster ..... A61G 7/015 |
| 2017/0172828 | A1 | 6/2017 | Zerhusen et al. |
| 2017/0172829 | A1 | 6/2017 | Tessmer et al. |
| 2017/0202717 | A1 | 7/2017 | Andersen et al. |
| 2017/0246065 | A1 | 8/2017 | Connell et al. |

FOREIGN PATENT DOCUMENTS

| | | | |
|---|---|---|---|
| EP | 1729612 | A1 | 12/2006 |
| WO | 0225636 | A2 | 3/2002 |
| WO | 2005092153 | A1 | 10/2005 |

* cited by examiner

PATIENT SUPPORT APPARATUS WITH CONTROL SYSTEM AND METHOD TO AVOID OBSTACLES DURING RECONFIGURATION

RELATED APPLICATIONS

This application claims priority to and the benefit of U.S. Provisional Patent Application No. 62/522,233, filed on Jun. 20, 2017, the entire contents and disclosures of which are hereby incorporated by reference.

BACKGROUND

Patient support apparatuses, such as hospital beds, stretchers, cots, tables, wheelchairs, and chairs facilitate care of patients in a health care setting. Conventional patient support apparatuses comprise a support structure having a patient support deck upon which the patient is supported, a lift system for lifting and lowering the patient support deck relative to the base, and an articulation system for articulating one or more sections of the patient support deck.

Sometimes, it is desirable for the lift system to move the patient support deck to a minimum height that eases ingress and egress of the patient or to a maximum height that eases access to patients or transport by caregivers. It is likewise desirable for the articulation system to move a back section to a fully lowered position that places a back of the patient in a generally flat position for sleeping or to a fully raised position that places the back of the patient upright for various purposes, such as eating, treatment, x-ray imaging, and the like. In some cases, when placing the patient support apparatus in such desirable configurations, obstacles can be encountered and can cause damage to the patient support apparatus or the obstacle.

A patient support apparatus is desired that addresses one or more of the aforementioned challenges.

DETAILED DESCRIPTION

Figure 1:
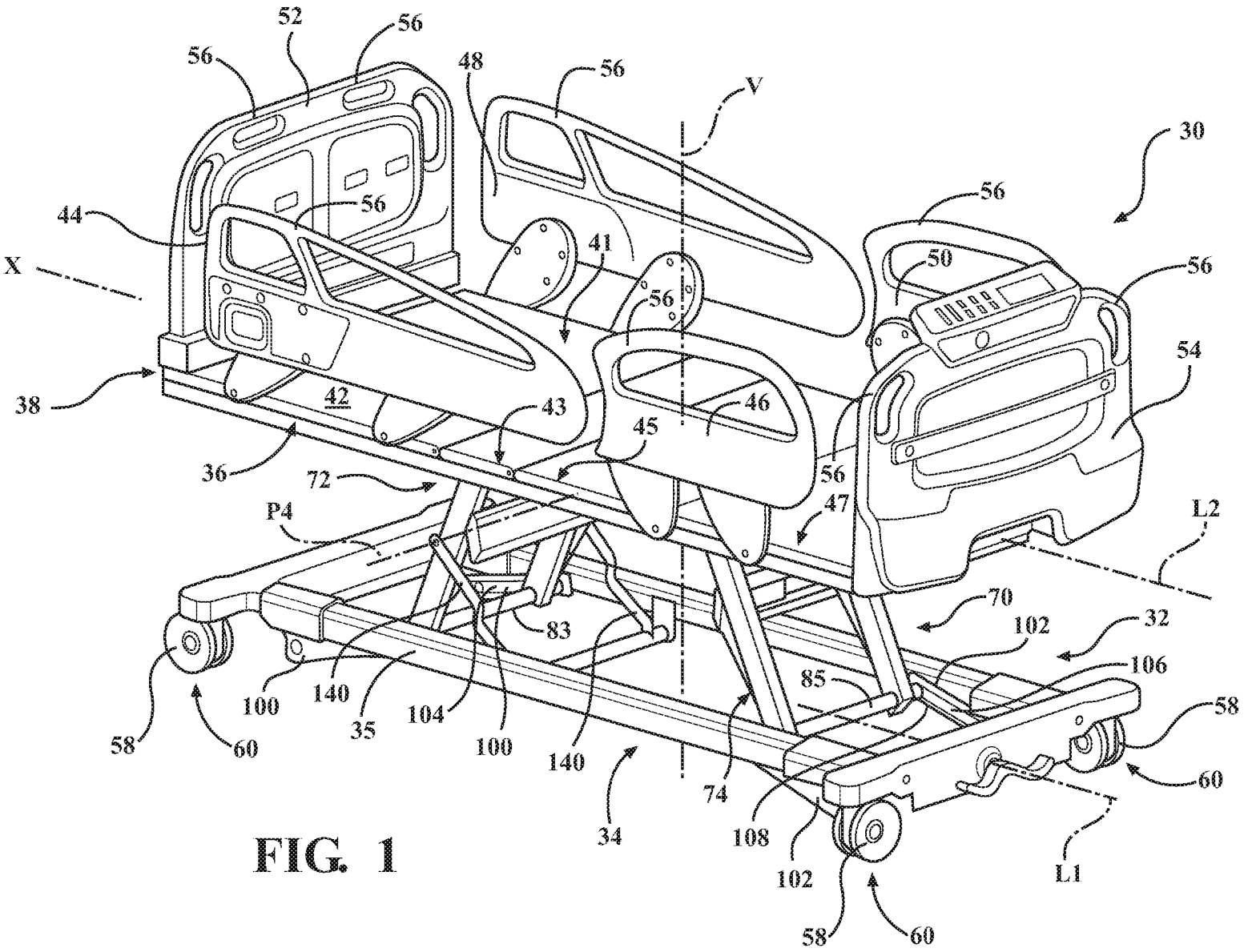
FIG. 1 is perspective view of a patient support apparatus.

Referring to FIG. 1, a patient support apparatus 30 is shown for supporting a patient in a health care setting. The patient support apparatus 30 illustrated in FIG. 1 comprises a hospital bed. In other embodiments, however, the patient support apparatus 30 may comprise a stretcher, cot, table, wheelchair, chair, or similar apparatus utilized in the care of a patient.

A support structure 32 provides support for the patient. The support structure 32 illustrated in FIG. 1 comprises a base 34 and a support frame 36. The base 34 comprises a base frame 35. The support frame 36 is spaced above the base frame 35 in FIG. 1. The support structure 32 also comprises a patient support deck 38 disposed on the support frame 36. The patient support deck 38 comprises several sections, some of which are capable of articulating (e.g., pivoting) relative to the support frame 36, such as a back (fowler) section 41, a seat section 43, a leg section 45, and a foot section 47. The patient support deck 38 provides a patient support surface 42 upon which the patient is supported.

A mattress 49 (shown in hidden lines in FIG. 2) is disposed on the patient support deck 38 during use. The mattress 49 comprises a secondary patient support surface upon which the patient is supported. The base 34, support frame 36, patient support deck 38, and patient support surfaces 42 each have a head end and a foot end corresponding to designated placement of the patient's head and feet on the patient support apparatus 30. The base 34 comprises a longitudinal axis L1 along its length from the head end to the foot end. The base 34 also comprises a vertical axis V arranged crosswise (e.g., perpendicularly) to the longitudinal axis L1 along which the support frame 36 is lifted and lowered relative to the base 34. The construction of the support structure 32 may take on any known or conventional design, and is not limited to that specifically set forth above. In addition, the mattress may be omitted in certain embodiments, such that the patient rests directly on the patient support surface 42.

Patient barriers, such as side rails 44, 46, 48, 50 are coupled to the support frame 36 and/or patient support deck 38 and are thereby supported by the base 34. A first side rail 44 is positioned at a right head end. A second side rail 46 is positioned at a right foot end. A third side rail 48 is positioned at a left head end. A fourth side rail 50 is positioned at a left foot end. In the embodiment shown, the head end side rails 44, 48 are mounted to the back section 41 for movement with the back section 41. The foot end side rails 46, 50 are mounted to the support frame 36 for movement with the support frame 36. If the patient support apparatus 30 is a stretcher or a cot, there may be fewer side rails. The side rails 44, 46, 48, 50 are movable relative to the back section 41/support frame 36 to a raised position in which they block ingress and egress into and out of the patient support apparatus 30, one or more intermediate positions, and a lowered position in which they are not an obstacle to such ingress and egress. In the embodiment shown, the side rails 44, 46, 48, 50 are connected to the back section 41 and/or the support frame 36 by pivotal support arms to form four bar linkages. Such side rails and the manner in which they may be raised/lowered are shown and described in U.S. Patent Application Pub. No. 2017/0172829, filed on Dec. 15, 2016 and entitled "Powered Side Rail For A Patient Support Apparatus," hereby incorporated by reference in its entirety.

A headboard 52 and a footboard 54 are coupled to the support frame 36. The headboard 52 and footboard 54 may be coupled to any location on the patient support apparatus 30, such as the support frame 36 or the base 34. In still other embodiments, the patient support apparatus 30 does not include the headboard 52 and/or the footboard 54.

Caregiver interfaces 56, such as handles, are shown integrated into the headboard 52, footboard 54, and side rails 44, 46, 48, 50 to facilitate movement of the patient support apparatus 30 over a floor surface F. Additional caregiver interfaces 56 may be integrated into other components of the patient support apparatus 30. The caregiver interfaces 56 are graspable by the caregiver to manipulate the patient support apparatus 30 for movement, to move the side rails 44, 46, 48, 50, and the like.

Other forms of the caregiver interface 56 are also contemplated. The caregiver interface may comprise one or more handles coupled to the support frame 36. The caregiver interface may simply be a surface on the patient support apparatus 30 upon which the caregiver logically applies force to cause movement of the patient support apparatus 30 in one or more directions, also referred to as a push location. This may comprise one or more surfaces on the support frame 36 or base 34. This could also comprise one or more surfaces on or adjacent to the headboard 52, footboard 54, and/or side rails 44, 46, 48, 50. In other embodiments, the caregiver interface may comprise separate handles for each hand of the caregiver. For example, the caregiver interface may comprise two handles.

Wheels 58 are coupled to the base 34 to facilitate transport over the floor surface F. The wheels 58 are arranged in each of four quadrants of the base 34 adjacent to corners of the base 34. In the embodiment shown, the wheels 58 are caster wheels able to rotate and swivel relative to the support structure 32 during transport. Each of the wheels 58 forms part of a caster assembly 60. Each caster assembly 60 is mounted to the base 34. It should be understood that various configurations of the caster assemblies 60 are contemplated. In addition, in some embodiments, the wheels 58 are not caster wheels and may be non-steerable, steerable, non-powered, powered, or combinations thereof. Additional wheels are also contemplated. For example, the patient support apparatus 30 may comprise four non-powered, non-steerable wheels, along with one or more powered wheels. In some cases, the patient support apparatus 30 may not include any wheels.

In other embodiments, one or more auxiliary wheels (powered or non-powered), which are movable between stowed positions and deployed positions, may be coupled to the support structure 32. In some cases, when these auxiliary wheels are located between caster assemblies 60 and contact the floor surface F in the deployed position, they cause two of the caster assemblies 60 to be lifted off the floor surface F thereby shortening a wheel base of the patient support apparatus 30. A fifth wheel may also be arranged substantially in a center of the base 34.

Figure 2:
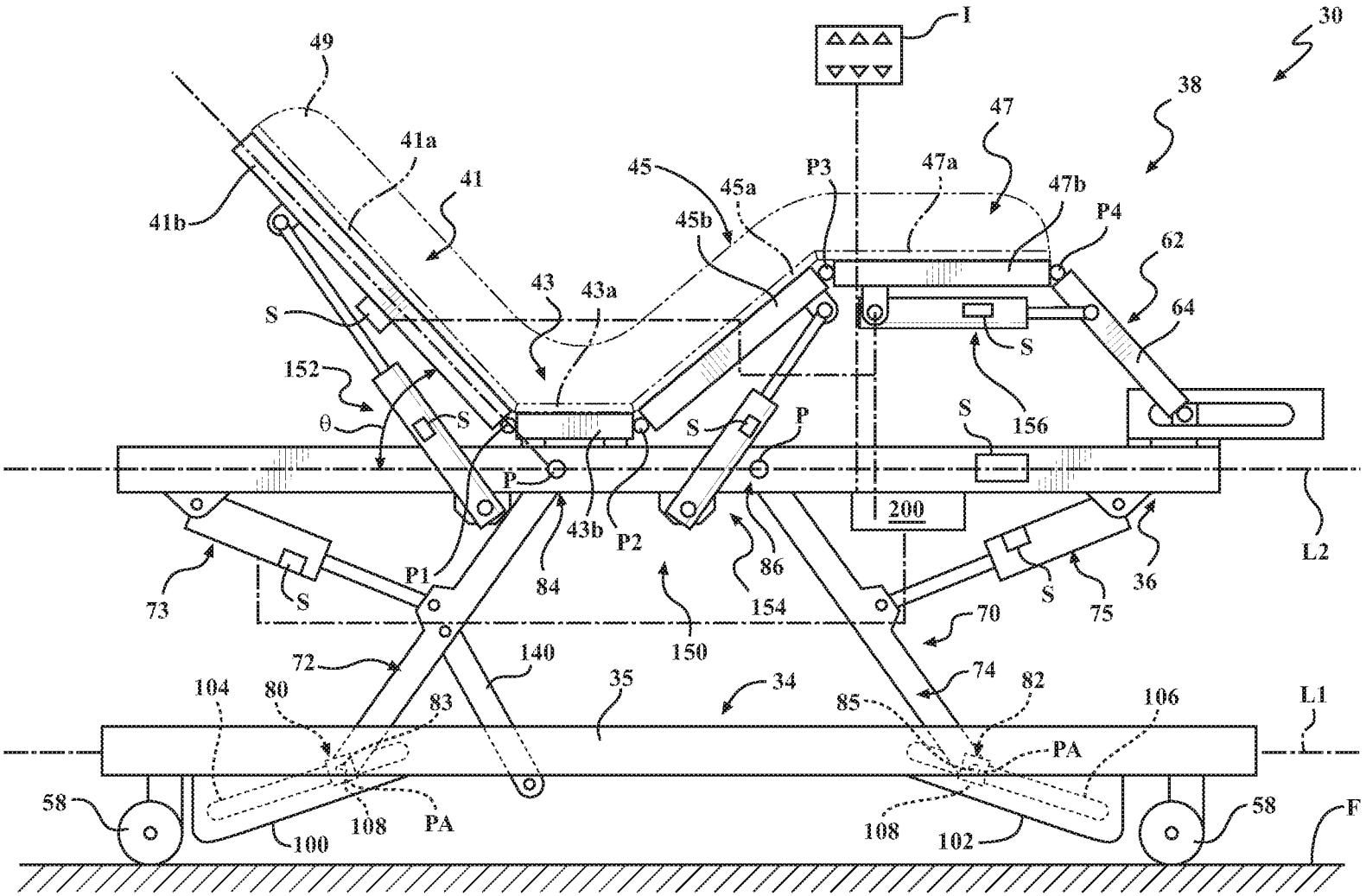
FIG. 2 is an elevational view of the patient support apparatus illustrating a lift system and an articulation system with a patient support deck at a maximum height.

Referring to FIG. 2, the patient support apparatus 30 is shown with the side rails 44, 46, 48, 50 removed for illustration purposes. The patient support apparatus 30 comprises a lift system 70 that operates to lift and lower the support frame 36/patient support deck 38 relative to the base 34. The lift system 70 is configured to move the support frame 36/patient support deck 38 from a minimum height (shown in FIG. 3) to a maximum height (shown in FIG. 2), or to any desired position in between. One exemplary lift system 70 is described below and in U.S. patent application Ser. No. 15/439,541, filed on Feb. 22, 2017, entitled "Lift Assembly for Patient Support Apparatus," hereby incorporated by reference herein in its entirety. Other types of lift systems can also be used, such as those described in U.S. Patent Application Publication No. 2016/0302985, filed on Apr. 20, 2016, entitled "Patient Support Lift Assembly," hereby incorporated by reference herein in its entirety.

The exemplary lift system 70 described herein comprises head end and foot end lift members 72, 74. First and second lift actuators 73, 75 move the lift members 72, 74 to lift and lower the support frame 36/patient support deck 38 relative to the base 34. The first actuator 73 is coupled to the head end lift member 72. The second actuator 75 is coupled to the foot end lift member 74. The lift actuators 73, 75 operate to pivot their respective lift member 72, 74 about fixed upper pivot axes P to lift and lower the support frame 36/patient support deck 38 relative to the base 34, as described further below. The lift actuators 73, 75 comprise linear actuators, rotary actuators, or other types of actuators. The lift actuators 73, 75 may be electrically operated, electro-hydraulic, hydraulic, pneumatic, and the like. In the embodiment shown, the lift actuators 73, 75 are electric, linear actuators.

In some embodiments, the lift members 72, 74 comprise a pair of head end lift legs and a pair of foot end lift legs pivoted by the lift actuators 73, 75 about the fixed upper pivot axes P. In other embodiments, each of the lift members 72, 74 may comprise a single lift leg. In still other embodiments, other types of lift members capable of lifting and lowering the support frame 36/patient support deck 38 may be employed. The lift members 72, 74 may be identical in form or may have different forms. For instance, one of the lift members 72, 74 may be a single lift leg, while the other of the lift members 72, 74 may comprise part of a scissor-type mechanism. It should be appreciated that each of the lift members 72, 74 may be formed in a unitary construction or may be separate pieces fastened together.

The lift members 72, 74 comprise first end sections 80, 82 movably coupled to the base 34. In particular, the first end sections 80, 82 are connected to guided bodies 108 that slide in head end and foot end guides 100, 102 relative to the base 34 during lifting and lowering, i.e., when the lift actuators 73, 75 pivot the lift members 72, 74 about the fixed upper pivot axes P. In the embodiment shown, the first end sections 80, 82 comprise first ends of the lift legs and a support member 83, 85 interconnecting each pair of the lift legs, respectively, at their first ends. In the embodiment shown, the support members 83, 85 are rigidly fixed to the lift legs to move with the lift legs. The support members 83, 85 define a moving lower pivot axis PA about which the support members 83, 85 pivot as the first end sections 80, 82 slide relative to the base 34. In other embodiments, the lift legs may pivot relative to the support members 83, 85.

The lift members 72, 74 extend from the first end sections 80, 82 to second end sections 84, 86. The second end sections 84, 86 are pivotally connected to the support frame 36 at the fixed upper pivot axes P for pivoting relative to the support frame 36. In the embodiment shown, the second end sections 84, 86 comprise second ends of the lift legs. The fixed upper pivot axes P lie in a common plane perpendicular to the vertical direction when the support frame 36/patient support deck 38 is at the minimum height or the maximum height.

The guides 100, 102 are arranged to guide the movement of the first end sections 80, 82 when the lift actuators 73, 75 pivot the lift members 72, 74 about the fixed upper pivot axes P to lift and lower the support frame 36/patient support deck 38 relative to the base 34. The head end guides 100 guide movement of the head end lift member 72. The foot end guides 102 guide movement of the foot end lift member 74. In the embodiment shown, four guides 100, 102 are provided. The four guides 100, 102 comprise a pair of head end guide tracks 104 and a pair of foot end guide tracks 106. The guide tracks 104, 106 are fixed to the base 34 and have a hollow, elongated shape. In particular, the guide tracks 104, 106 are shown being formed of rectangular tubing. In other embodiments, the guides may assume other forms or shapes capable of guiding movement of the first end sections 80, 82 of the lift members 72, 74.

The guided bodies 108 are rotatably coupled to the lift members 72, 74 to rotate relative to the lift members 72, 74 when sliding in the guides 100, 102. More specifically, the guided bodies 108 are rotatably connected at each end of the support members 83, 85 to pivot about the lower pivot axes PA as the guided bodies 108 slide in the guide tracks 104, 106. The guided bodies 108 are captured in the guide tracks 104, 106 to prevent withdrawal. In the embodiment shown, the guided bodies 108 comprise blocks and the guide tracks 104, 106 comprise slide-bearing guide tracks in which the blocks slide. The blocks can be any shape, including box-shaped, spherical, cylindrical, or the like. In other embodiments, the guided bodies 108 comprise rollers, gears, or other movable elements. In further embodiments, the guide tracks 104, 106 comprise racks and the guided bodies 108 comprise gears movable along the racks.

In the embodiment shown, each of the lift actuators 73, 75 comprises a housing and a drive rod that extends and retracts relative to the housing to pivot the lift members 72, 74 about their fixed upper pivot axes P. The lift actuators 73, 75 have a housing end that is pivotally connected to the support frame 36. The lift actuators 73, 75 extend from the housing end to a rod end that is pivotally connected to the lift members 72, 74. The lift actuators 73, 75 are pivotally connected to the support frame 36 and the lift members 72, 74 at actuator mounts, such as fixed pivot brackets. The lift actuators 73, 75 can be operated independently to place the support frame 36 in a Trendelenburg or reverse Trendelenburg position.

A timing link 140 is pivotally connected at a first end to one of the lift members 72, 74 and pivotally connected at a second end to the base frame 35. In particular, in the embodiment shown, two timing links 140 (see FIG. 1) are pivotally connected to the base frame 35 to pivot about a pivot axis and are pivotally connected to the head end lift member 72 to pivot about another pivot axis. Additional timing links 140 could also be pivotally connected to the foot end lift member 74 in other embodiments.

The deck sections 41, 43, 45, 47 are shown in FIG. 2 in a configuration in which the back section 41 is raised above the support frame 36, the seat section 43 is fixed to the support frame 36 (such as by welding, fasteners, or the like), the leg section 45 is raised above the support frame 36, and the foot section 47 is elevated above the support frame 36 in a plane parallel to the second longitudinal axis L2.

The deck sections 41, 43, 45, 47 are pivotally coupled together in series at pivot joints defined about pivot axes P1, P2, P3. Each of the deck sections 41, 43, 45, 47 have a first end and a second end. The first end is closer to the head end of the patient support apparatus 30 when the patient support deck 38 is in a flat configuration and the second end is closer to the foot end of the patient support apparatus 30 when the patient support deck 38 is in the flat configuration. In the embodiment shown, the second end of the back section 41 is pivotally coupled to the first end of the seat section 43 about pivot axis P1. The first end of the leg section 45 is pivotally coupled to the second end of the seat section 43 about pivot axis P2. The first end of the foot section 47 is pivotally coupled to the second end of the leg section 45 about pivot axis P3.

The deck sections 41, 43, 45, 47 may be pivotally coupled together by pivot pins, shafts, and the like at the pivot joints. Pivot brackets may be employed to form the pivot joints. Additionally, other types of connections are possible between the deck sections 41, 43, 45, 47 so that the deck sections 41, 43, 45, 47 are capable of moving, e.g., articulating, relative to one another. For instance, in some cases, translational joints may be provided between adjacent deck sections, or other compound movement connections may be provided between adjacent deck sections, such as joints that allow both pivotal and translational motion between adjacent deck sections. Further, in other cases, the back section 41 and the leg section 45 may be connected directly to the support frame 36 or other part of the support structure 32 for relative articulation, instead of being directly connected to the seat section 43.

As shown by hidden lines, the deck sections 41, 43, 45, 47 comprise deck panels 41*a*, 43*a*, 45*a*, 47*a*, removably coupled to deck section frames 41*b*, 43*b*, 45*b*, 47*b*. It should be appreciated that, in other embodiments, the deck sections 41, 43, 45, 47 may comprise only the deck section frames 41*b*, 43*b*, 45*b*, 47*b* or only the deck panels 41*a*, 43*a*, 45*a*, 47*a*. The deck panels 41*a*, 43*a*, 45*a*, 47*a* may be plastic panels that snap fit or are otherwise capable of being easily removed from the deck section frames 41*b*, 43*b*, 45*b*, 47*b* for cleaning, etc. The deck panels 41*a*, 43, 45*a*, 47*a*, could also be formed of other materials and may be permanently affixed to the deck sections frames 41*b*, 43*b*, 45*b*, 47*b*. Each of the deck section frames 41*b*, 43*b*, 45*b*, 47*b* may be formed of metal and comprise structural members (e.g., metal bars and tubes) welded together to form a support framework. The deck sections frames 41*b*, 43*b*, 45*b*, 47*b* could also be formed of other materials and comprise only single members, such as a single panel, frame, or other type of support structure.

A support link 62 extends between the support frame 36 and the foot section 47 to support the foot section 47. The support link 62 is arranged to support the second end of the foot section 47 with respect to the support frame 36. The support link 62 has a first link end pivotally coupled to the second end of the foot section 47 about pivot axis P4. The support link 62 extends from the first link end to a second link end pivotally and slidably coupled to the support frame 36. In the embodiment shown, the support link 62 comprises a pair of spaced apart support arms 64. In other embodiments, the support link 62 may comprise only a single support arm, or other type of support member (or members) that support the second end of the foot section 47 with respect to the support frame 36. Prop rods or other types of support links could also be employed.

An articulation system 150 comprises articulation actuators 152, 154, 156 operable to move the back section 41, leg section 45, and foot section 47. The articulation actuators 152, 154, 156 may be linear actuators, rotary actuators, or other type of actuators capable of moving the back section 41, leg section 45, and foot section 47. The articulation actuators 152, 154, 156 may be electrically powered, hydraulic, electro-hydraulic, pneumatic, or the like. In the embodiment shown, the articulation actuators 152, 154, 156 are electrically powered linear actuators comprising actuator housings and drive rods that extend and retract with respect to their associated actuator housing. Hereinafter, the articulation actuators 152, 154, 156 may be referred to as back section actuator 152, leg section actuator 154, and foot section actuator 156.

The back section actuator 152 is operatively connected to the back section 41 to pivot, or otherwise articulate, the back section 41 relative to the support frame 36 between a fully lowered position and one or more raised positions. More specifically, the back section actuator 152 pivots the back section 41 about pivot axis P1 relative to the seat section 43. In the embodiment shown, the back section actuator 152 is pivotally connected at a first actuator end to a mounting bracket fixed to the support frame 36. The back section actuator 152 is pivotally connected at a second actuator end to a mounting bracket fixed to the back section 41. The back section actuator 152 could be pivotally connected to these brackets via pivot pins, shafts, and the like. In other embodiments, the back section actuator 80 may be connected through other types of connections or linkages in order to move the back section 41 to the fully lowered position or the one or more raised positions.

The leg section actuator 154 is operatively connected to the leg section 45 to pivot, or otherwise articulate, the leg section 45 relative to the support frame 36 between a fully lowered position and one or more raised positions. More specifically, the leg section actuator 154 pivots the leg section 45 about pivot axis P2 relative to the seat section 43. Owing to the pivotal coupling of the second end of the leg section 45 to the first end of the foot section 47, when the leg section 45 is moved, the first end of the foot section 47 is also moved. In the embodiment shown, the leg section actuator 154 is pivotally connected at a first actuator end to a mounting bracket fixed to the support frame 36. The leg section actuator 154 is pivotally connected at a second actuator end to a mounting bracket fixed to the leg section 45. The leg section actuator 154 could be pivotally connected to these brackets via pivot pins, shafts, and the like. In other embodiments, the leg section actuator 154 may be connected through other types of connections or linkages in order to move the leg section 45 to the fully lowered position or the one or more raised positions.

The foot section actuator 156 is operatively connected to the support link 62 to move, e.g., articulate, the support link 62 relative to the foot section 47. Movement of the support link 62 causes the foot section 47 to pivot, or otherwise articulate, relative to the leg section 45 between different foot section positions. In the embodiment shown, the foot section actuator 156 is pivotally connected at a first actuator end to a mounting bracket fixed to the foot section 47. The foot section actuator 156 is pivotally connected at a second actuator end to a mounting bracket fixed to the support link 62. The foot section actuator 156 could be pivotally connected to these brackets via pivot pins, shafts, and the like. In other embodiments, the foot section actuator 156 may be connected to the foot section 47 or the support link 62 through other types of connections or linkages.

A control system is provided to control operation of the actuators 73, 75, 152, 154, 156. The control system comprises a controller 200 (see FIG. 2) having one or more microprocessors, microcontrollers, field programmable gate arrays, systems on a chip, discrete circuitry, and/or other suitable hardware, software, or firmware that is capable of carrying out the functions described herein. The controller 200 may be carried on-board the patient support apparatus 30, or may be remotely located. In one embodiment, the controller 200 is mounted to the base 34. In other embodiments, the controller 200 is mounted to the footboard 54. Power to the actuators 73, 75, 152, 154, 156 and/or the controller 200 may be provided by a battery power supply and/or an external power source. The controller 200 is coupled to the actuators 73, 75, 152, 154, 156 in a manner that allows the controller 200 to control the actuators 73, 75, 152, 154, 156 (connections shown schematically in FIG. 2). The controller 200 may communicate with the actuators 73, 75, 152, 154, 156 via wired or wireless connections to perform one of more desired functions.

The controller 200 is configured to process instructions or to process an algorithm stored in memory to control operation of the lift actuators 73, 75 to coordinate movement of the lift actuators 73, 75 and evenly lift and lower the support frame 36 relative to the base 34 or to independently operate the lift actuators 73, 75 to place the support frame 36 in the Trendelenburg or reverse Trendelenburg positions. The controller 200 also controls operation of the articulation actuators 152, 154, 156 to articulate the deck sections 41, 45, 47 sequentially, simultaneously, and/or in a coordinated manner with the lift actuators 73, 75.

The controller 200 may monitor a current state of the actuators 73, 75, 152, 154, 156 and determine desired states in which the actuators 73, 75, 152, 154, 156 should be placed, based on one or more input signals that the controller 200 receives from one or more input devices, such as from a sensor system comprising sensors S integrated into the actuators 73, 75, 152, 154, 156. The state of the actuators 73, 75, 152, 154, 156 may be a position, a relative position, an angle, an energization status (e.g., on/off), or any other parameter of the actuators 73, 75, 152, 154, 156. The sensors S also provide input to the controller 200 associated with various states of the patient support apparatus 30. For instance, a sensor S fixed to the back section 41 may be used to determine a state of the back section 41 (e.g., an angle θ in FIG. 2 relative to the support frame 36, relative to the base 34, relative to gravity, relative to the floor surface F, or the like). A sensor S integrated into the back section actuator 152 could likewise determine the state of the back section 41 (e.g., angle θ) by virtue of measuring extension/retraction of the drive rod from the housing, measuring rotations of a motor used in the back section actuator 152, etc. Another sensor S may be fixed to the support frame 36 to determine a state of the support frame 36/patient support deck 38 (e.g., an inclination of the support frame 36, a height of the support frame 36/patient support deck 38 from the floor surface F, and the like). The sensors S may comprise potentiometers, optical sensors, hall-effect sensors, encoders, accelerometers, gyroscopes, inclinometers, etc.

The user, such as a caregiver, may actuate a user input device I (see FIG. 2), which transmits a corresponding input signal to the controller 200, and the controller 200 controls operation of the actuators 73, 75, 152, 154, 156 based on the input signal. The user input devices I may comprise any device capable of being actuated by the user. The user input devices I may be configured to be actuated in a variety of different ways, including but not limited to, mechanical actuation (hand, foot, finger, etc.), hands-free actuation (voice, foot, etc.), and the like. The user input devices I may comprise buttons, such as separate buttons corresponding to lift, lower, Trendelenburg, reverse Trendelenburg, raise back section 41, lower back section 41, raise leg section 45, lower leg section 45, raise foot section 47, lower foot section 47, etc.

The user input devices I may also comprise a gesture sensing device for monitoring motion of hands, feet, or other body parts of the user (such as through a camera), a microphone for receiving voice activation commands, a foot pedal, and a sensor (e.g., infrared sensor such as a light bar or light beam to sense a user's body part, ultrasonic sensor, etc.). Additionally, the buttons/pedals can be physical buttons/pedals or virtually implemented buttons/pedals such as through optical projection or on a touchscreen. The buttons/pedals may also be mechanically connected or drive-by-wire type buttons/pedals where a user applied force actuates a sensor, such as a switch or potentiometer. It should be appreciated that any combination of user input devices I may also be utilized. The user input devices I may be located on one of the side rails 44, 46, 48, 50, the headboard 52, the footboard 54, or other suitable locations. The user input devices I may also be located on a portable electronic device (e.g., iWatch®, iPhone®, iPad®, or similar electronic devices).

During operation, when a user wishes to lift/lower the support frame 36/patient support deck 38 relative to the base 34 or to move one of the deck sections 41, 45, 47, the user actuates one or more of the user input devices I. For instance, in the event the user wishes to lower the support frame 36 relative to the base 34, such as moving the support frame 36 from the position shown in FIG. 2 to the position shown in FIG. 3, the user actuates the appropriate user input device I. Upon actuation, the controller 200 sends output signals to the lift actuators 73, 75 to cause operation of the lift actuators 73, 75 in a manner that causes the support frame 36 to lower. In the embodiment shown, this includes both of the lift actuators 73, 75 being commanded by the controller 200 to retract their associated drive rods into their housings. As a result, owing to the pivotal connection of the rod ends to the lift members 72, 74, each of the lift members 72, 74 pivots about their respective fixed upper pivot axis P so that the first end sections 80, 82 of the lift members 72, 74 begin to move away from one another while being guided by the guides 100, 102.

Figure 3:
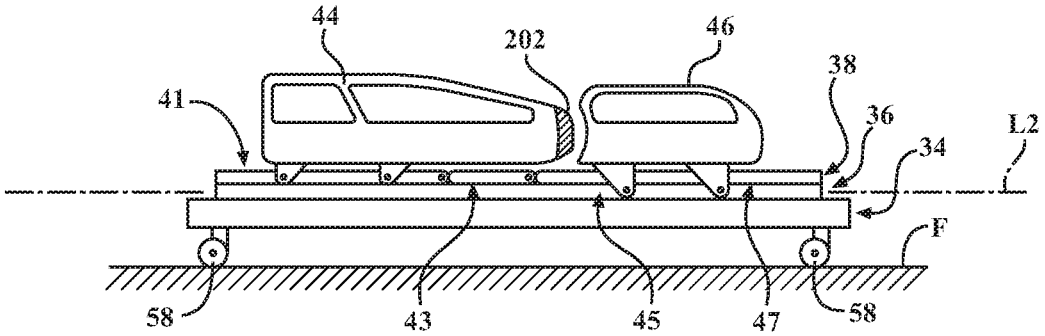
FIG. 3 is an illustration of the patient support apparatus with the patient support deck at a minimum height and in a first configuration.
Figure 4:
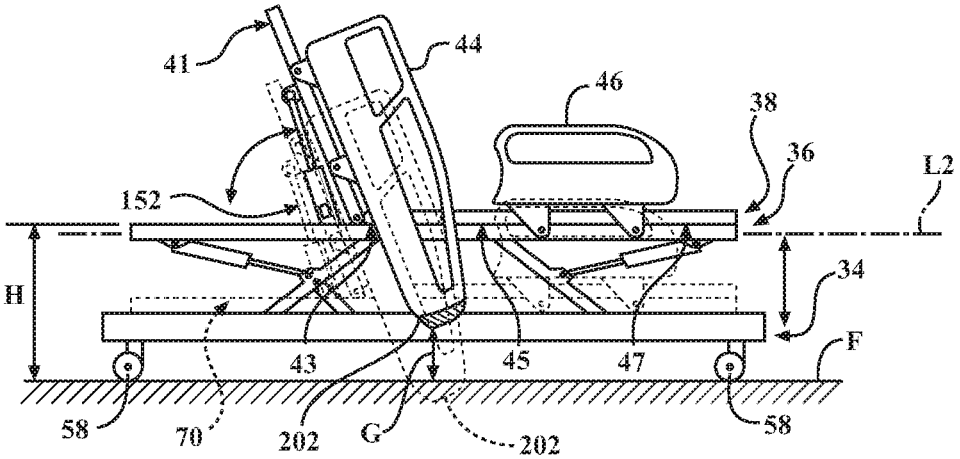
FIG. 4 is an illustration of the patient support deck transitioning to a second configuration with a back section of the patient support deck being raised and the patient support deck being lifted.
Figure 5:
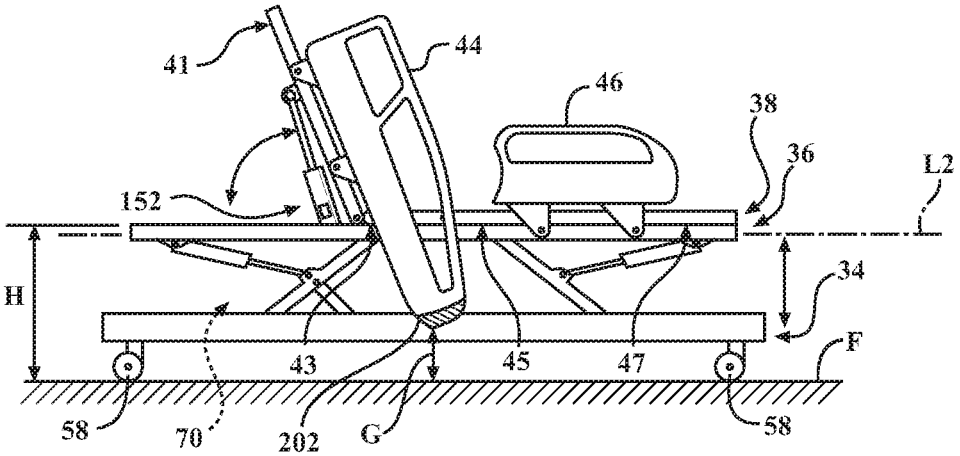
FIG. 5 is an illustration of the patient support deck in the second configuration with a back section of the patient support deck raised.

In the event the user wishes to raise or lower the back section 41 relative to the seat section 43, such as moving the back section 41 from the position shown in FIG. 3 to the position shown in FIG. 4, the user actuates the appropriate user input device I. Upon actuation, the controller 200 sends output signals to the back section actuator 152 to cause operation of the back section actuator 152 in a manner that causes the back section 41 to be raised. In the embodiment shown, this includes the back section actuator 152 being commanded by the controller 200 to extend the associated drive rod from the housing. As a result, the back section 41 articulates (e.g., pivots) about pivot axis P1 relative to the seat section 43 and the support frame 36.

Referring specifically to FIGS. 3 and 4, during operation of one or more of the actuators 73, 75, 152, 154, 156, there is a possibility that, owing to the size and shape of the head end side rails 44, 48, outer portions 202 of the head end side rails 44, 48 could impact the floor surface F. More specifically, in the case where the lift system 70 has moved the support frame 36/patient support deck 38 to the minimum height, i.e., a low height position, subsequent articulation of the back section 41 relative to the support frame 36 could result in the outer portions 202 contacting the floor surface F or other obstacles (e.g., feet, objects, etc.) located between the outer portions 202 and the floor surface F. See the hidden lines in FIG. 4 that illustrate how the outer portions 202 would strike the floor surface F when the support frame 36/patient support deck 38 are at their minimum height, i.e., low height position, if the back section 41 was allowed to articulate upwardly without also moving from the low height position. The position of the back section 41 and the height of the support frame 36/patient support deck 38 could be detected/determined by any of the sensors S previously described or by other methods. For instance, the position of the back section 41 or the height of the support frame 36/patient support deck 38, may be directly measured, inferred from measurements of sensors S integrated into the actuators 73, 75, 152 or correlated to other sensor measurements.

Referring to FIG. 4, since the outer portions 202 would otherwise strike the floor surface F, the controller 200 acts to provide automated movement or limits movement to prevent collisions. In one case, the controller 200 may operate the lift system 70 in an automated manner to lift the support frame 36/patient support deck 38 relative to the base 34 in response to the back section actuator 152 being operated by a user to articulate the back section 41. This automated movement is provided so that the outer portion 202 of the side rail 44 remains spaced from the floor surface F by a gap G. As shown, for instance, the controller 200 is configured to operate the lift system 70 in an automated manner to lift the support frame 36/patient support deck 38 relative to the base 34 toward their maximum height in response to the back section actuator 152 being operated by the user to articulate a head end of the back section 41 upwardly while the support frame 36/patient support deck 38 is at the minimum height, or any other height in which contact with the floor surface F and/or failure to maintain the gap G is possible.

This automated movement may occur, for example, when the sensor system detects that the back section 41 has been articulated to an acute angle θ of at least 30, 40, 50, 60, or 70 degrees, when the user is raising the back section 41 so that the acute angle θ falls between 60 and 90 degrees, or in response to reaching some other threshold. In the embodiment shown, the greater the acute angle θ, the greater the likelihood that lifting of the support frame 36/patient support deck 38 toward the maximum height is needed to avoid contact of the outer portions 202 with the floor surface F and/or to maintain the gap G.

In some instances, this automated movement may additionally or alternatively comprise the controller 200 automatically moving (e.g., raising/translating/articulating) the side rail 44 to avoid hitting the floor surface F or other obstacles. For instance, the side rail 44 may be powered by electric actuators such that the controller 200 is able to raise, lower, translate, and/or articulate the side rail 44 relative to the support frame 36/patient support deck 38. Such a powered side rail is shown and described in U.S. Patent Application Pub. No. 2017/0172829, filed on Dec. 15, 2016 and entitled "Powered Side Rail For A Patient Support Apparatus," hereby incorporated by reference herein in its entirety.

In some instances, the back section 41/side rail 44 may be able to fully articulate without concern for hitting the floor surface F or other obstacles. For example, the controller 200 may be configured to enable operation of the back section actuator 152 to articulate the back section 41 relative to the support frame 36 in a full range of movement when the support frame 36/patient support deck 38 is at the maximum height, or any other height above the minimum height in which contact with the floor surface F can be avoided and/or the gap G can be maintained, regardless of articulation of the back section 41.

Alternatively, or additionally, in situations in which the support frame 36/patient support deck 38 are already elevated above the minimum height, the controller 200 may operate the back section actuator 152 in an automated manner to articulate the back section 41 downwardly in response to the lift system 70 being operated to lower the support frame 36/patient support deck 38. This automated movement is provided so that the outer portion 202 of the side rail 44 remains spaced from the floor surface F. For instance, the controller 200 may be configured to operate the back section actuator 152 in an automated manner to articulate a head end of the back section 41 downwardly toward the fully lowered position in response to the lift system 70 being operated by the user to lower the support frame 36/patient support deck 38 while the back section 41 is at the fully raised position, or any other position above the fully lowered position in which contact with the floor surface F and/or failure to maintain the gap G is possible.

This automated movement may occur, for example, when the sensor system detects that the support frame 36/patient support deck 38 has been lowered to a height H of less than 20, 15, 10, 8, or 5 inches from the floor surface F, or has reached some other height-related threshold. In the embodiment shown, the lower the height H, the greater the likelihood that articulation of the back section 41 toward the fully lowered position is needed to avoid contact of the outer portions 202 with the floor surface F and/or to maintain the gap G. In some instances, this automated movement may additionally or alternatively comprise the controller 200 automatically moving (e.g., raising/translating/articulating) the side rail 44 to avoid hitting the floor surface F or other obstacles as previously described.

In some instances, the lift system 70 may be able to fully lift/lower the support frame 36/patient support deck 38 without concern for hitting the floor surface F or other obstacles. For example, the controller 200 may be configured to enable operation of the lift system 70 to lift or lower the support frame 36/patient support deck 38 relative to the base 34 in a full range of movement when the back section 41 is in the fully lowered position, or any other position below the fully raised position in which contact with the floor surface F can be avoided and/or the gap G can be maintained, regardless of the height of the support frame 36/patient support deck 38.

In another example, the controller 200 may limit operation of the lift system 70 to lower the support frame 36/patient support deck 38 relative to the base 34 based on a position of the back section 41/side rail 44 so that the outer portion 202 of the side rail 44 remains spaced from the floor surface F. More specifically, the controller 200 may be configured to limit operation of the lift system 70 to lower the support frame 36/patient support deck 38 when the back section 41/side rail 44 is at the fully raised position or any other position above the fully lowered position in which contact with the floor surface F or failure to maintain the gap G is possible upon lowering of the support frame 36/patient support deck 38.

Alternatively, or additionally, the controller 200 may limit operation of the back section actuator 152 to articulate the back section 41/side rail 44 based on the height H of the support frame 36/patient support deck 38 so that the outer portion 202 of the side rail 44 remains spaced from the floor surface F. More specifically, the controller 200 may be configured to limit operation of the back section actuator 152 to articulate the head end of the back section 41/side rail 44 upwardly when the support frame 36/patient support deck 38 is at the minimum height or any other height in which contact with the floor surface F or failure to maintain the gap G is possible upon articulating the head end of the back section 41/side rail 44 upwardly.

Figure 6:
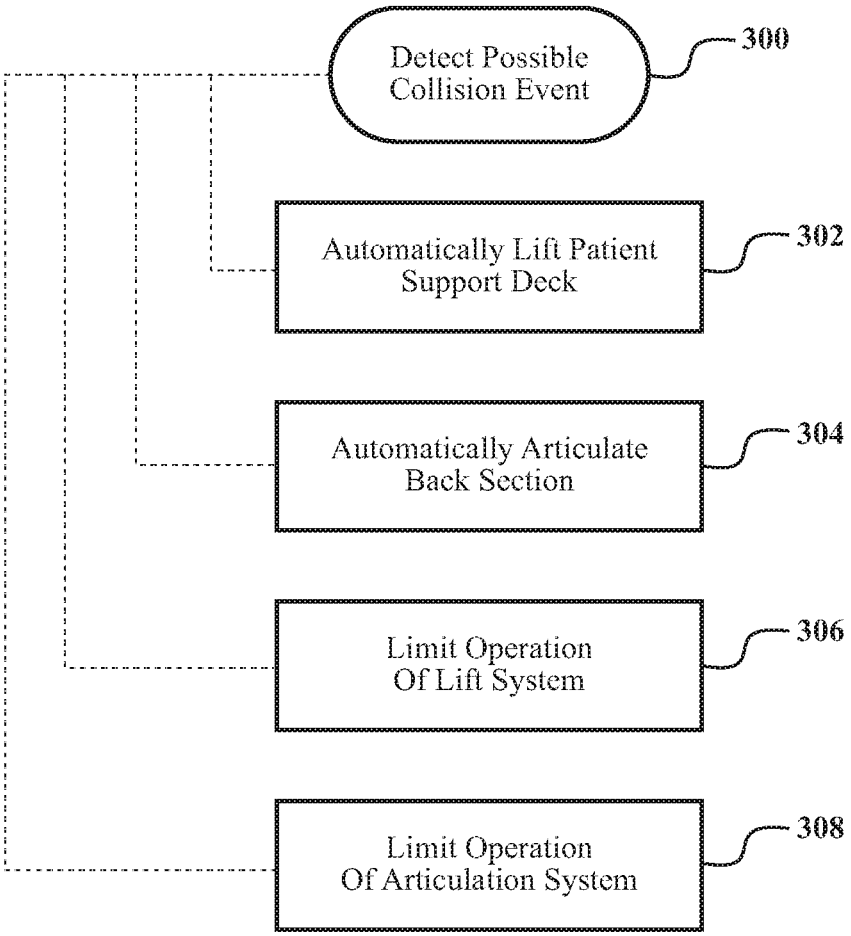
FIG. 6 is a flow diagram of an exemplary method.

Referring to FIG. 6, an exemplary method of controlling operation of the lift system 70 and/or the articulation system 150 is shown. In step 300, the method starts by first detecting that a collision event is possible. This may comprise detecting that the user is lowering the support frame 36/patient support deck 38 while the back section 41/side rail 44 is at a position susceptible to possible collision, detecting that the user is raising the back section 41/side rail 44 when the support frame 36/patient support deck 38 is at a height in which the side rail 44 is susceptible to possible collision, or the like. Once the possibility of a collision is detected by the controller 200, the method continues to at least one of four actions 302, 304, 306, 308 based on the situation. In step 302, the controller 200 automatically operates the lift system 70 to lift the support frame 36/patient support deck 38. In step 304, the controller 200 automatically operates the back section actuator 152 to articulate the back section 41/side rail 44 (e.g., toward the fully lowered position). In step 306, the controller 200 automatically sets a limit on operation of the lift system 70 to prevent the user from lowering the support frame 36/patient support deck 38 to a height/position in which a collision could occur. In step 308, the controller 200 automatically sets a limit on operation of the articulation system 150 to prevent the user from raising the back section 41/side rail 44 to a position in which a collision could occur.

Ultimately, in the embodiments shown, the control system described herein is employed to avoid collisions of the head end side rails 44, 48 with obstacles, such as the floor surface F. The control system and methodology described herein could likewise be employed on any of the side rails 44, 46, 48, 50, other articulating components of the patient support apparatus 30, or any other components of the patient support apparatus 30.

It will be further appreciated that the terms "include," "includes," and "including" have the same meaning as the terms "comprise," "comprises," and "comprising."

Several embodiments have been discussed in the foregoing description. However, the embodiments discussed herein are not intended to be exhaustive or limit the invention to any particular form. The terminology which has been used is intended to be in the nature of words of description rather than of limitation. Many modifications and variations are possible in light of the above teachings and the invention may be practiced otherwise than as specifically described.

What is claimed is:

1. A patient support apparatus comprising:

a support structure comprising a base for contacting a floor surface and a patient support deck, said patient support deck comprising a first section and a second section capable of articulating relative to said first section about a first pivot axis, a lift system configured to lift or lower said patient support deck relative to said base between a minimum height relative the floor surface and a maximum height relative the floor surface;

an articulation system configured to articulate said second section relative to said first section;

a patient barrier coupled to said second section and configured to articulate with said second section when said second section articulates relative to said first section, said patient barrier extending from adjacent said second section to an outer portion disposed beyond said first pivot axis by a length greater than said minimum height, said outer portion arranged to move relative to a floor surface when said patient barrier articulates with said second section;

a sensor system to determine a height of said patient support deck and a position of said second section; and a controller coupled to said lift system, said articulation system, and said sensor system, said controller configured to at least one of:

operate said lift system in an automated manner to lift said patient support deck relative to said base based on the height of said patient support deck and the position of said second section determined by said sensor system in response to said articulation system being operated to articulate said second section so that said outer portion of said patient barrier remains spaced from the floor surface; and operate said articulation system in an automated manner to articulate said second section based on the height of said patient support deck and the position of said second section determined by said sensor system in response to said lift system being operated to lower said patient support deck so that said outer portion of said patient barrier remains spaced from the floor surface.

2. The patient support apparatus of claim 1, wherein said controller is configured to operate said lift system in an automated manner to lift said patient support deck relative to said base toward said maximum height in response to said articulation system being operated to articulate a head end of said second section upwardly when said patient support deck is at said minimum height.

3. The patient support apparatus of claim 2, wherein said controller is configured to enable operation of said articulation system to articulate said second section relative to said first section in a full range of movement when said patient support deck is at said maximum height.

4. The patient support apparatus of claim 1, wherein said articulation system is operable to move said second section from a fully lowered position to a fully raised position, said controller configured to operate said articulation system in an automated manner to articulate a head end of said second section downwardly toward said fully lowered position in response to said lift system being operated to lower said patient support deck when said second section is at said fully raised position.

5. The patient support apparatus of claim 4, wherein said controller is configured to enable operation of said lift system to lift or lower said patient support deck relative to said base in a full range of movement when said second section is in said fully lowered position.

6. The patient support apparatus of claim 1, wherein said first section comprises a seat section and said second section comprises a back section configured to articulate relative to said seat section from a fully lowered position to a fully raised position, said patient barrier comprising a pair of side rails connected to said back section and configured to move relative to said back section.

7. The patient support apparatus of claim 6, wherein said support structure comprises a support frame with said patient support deck coupled to said support frame, said back section being arranged at an acute angle to said support frame in said fully raised position.

8. The patient support apparatus of claim 7, wherein said acute angle is greater than 60 degrees.

9. The patient support apparatus of claim 1, wherein said lift system comprises one or more lift actuators and said articulation system comprises one or more articulation actuators.

10. A patient support apparatus comprising:

a support structure comprising a base for contacting a floor surface and a patient support deck, said patient support deck comprising a first section and a second section capable of articulating relative to said first section about a first pivot axis, a lift system configured to lift or lower said patient support deck relative to said base between a minimum height relative to the floor surface and a maximum height relative the floor surface;

an articulation system configured to articulate said second section relative to said first section;

a patient barrier coupled to said second section and configured to articulate with said second section when said second section articulates relative to said first section, said patient barrier extending from adjacent said second section to an outer portion disposed beyond said first pivot axis by a length greater than said minimum height, said outer portion arranged to move relative to a floor surface when said patient barrier articulates with said second section;

a sensor system to determine a height of said patient support deck and a position of said second section; and a controller coupled to said lift system, said articulation system, and said sensor system, said controller configured to at least one of:

limit operation of said lift system to lower said patient support deck relative to said base based on a position of said patient barrier defined based on the position of said second section determined by said sensor system so that said outer portion of said patient barrier remains spaced from the floor surface; and limit operation of said articulation system to articulate said second section based on a height of said patient support deck determined by said sensor system so that said outer portion of said patient barrier remains spaced from the floor surface.

11. The patient support apparatus of claim 10, wherein said controller is configured to limit operation of said articulation system to articulate a head end of said second section upwardly when said patient support deck is at said minimum height.

12. The patient support apparatus of claim 11, wherein said controller is configured to enable operation of said articulation system to articulate said second section relative to said first section in a full range of movement when said patient support deck is at said maximum height.

13. The patient support apparatus of claim 10, wherein said articulation system is operable to move said second section from a fully lowered position to a fully raised position, said controller configured to limit operation of said lift system to lower said patient support deck when said second section is at said fully raised position.

14. The patient support apparatus of claim 13, wherein said controller is configured to enable operation of said lift system to lift or lower said patient support deck relative to said base in a full range of movement when said second section is in said fully lowered position.

15. The patient support apparatus of claim 10, wherein said first section comprises a seat section and said second section comprises a back section configured to articulate relative to said seat section from a fully lowered position to a fully raised position, said patient barrier comprising a pair of side rails connected to said back section and configured to move relative to said back section.

16. The patient support apparatus of claim 15, wherein said support structure comprises a support frame with said patient support deck coupled to said support frame, said back section being arranged at an acute angle to said support frame in said fully raised position.

17. The patient support apparatus of claim 16, wherein said acute angle is greater than 60 degrees.

18. The patient support apparatus of claim 10, wherein said lift system comprises one or more lift actuators and said articulation system comprises one or more articulation actuators.

* * * * *